US005487233A

United States Patent [19]

Jewell, Arnold W.

[11] Patent Number: 5,487,233

[45] Date of Patent: Jan. 30, 1996

[54] TRIGGER MECHANISM FOR FIREARMS

[76] Inventor: Jewell, Arnold W., 1490 White Water Rd., New Braunfels, Tex. 78132

[21] Appl. No.: 388,144

[22] Filed: Feb. 13, 1995

[51] Int. Cl.[6] ..... F41A 19/16

[52] U.S. Cl. ..... 42/69.01; 89/136

[58] Field of Search ..... 42/69.01, 69.02; 89/136, 27.11

[56] References Cited

U.S. PATENT DOCUMENTS

| | | | |
|---|---|---|---|
| 2,249,232 | 7/1941 | Smith | 42/69.02 |
| 2,584,299 | 2/1952 | Sefried, II | 42/69.02 |
| 3,950,876 | 4/1976 | Wild et al. | 42/69.02 |
| 4,671,005 | 6/1987 | Jewell | 42/69.02 |
| 4,908,970 | 3/1990 | Bell | 42/69.01 |

FOREIGN PATENT DOCUMENTS

| | | | |
|---|---|---|---|
| 19857 | 10/1956 | Germany | 42/69.02 |
| 2053006 | 5/1972 | Germany | 42/69.02 |
| 2253199 | 5/1974 | Germany | 42/69.02 |

*Primary Examiner*—Stephen M. Johnson
*Attorney, Agent, or Firm*—Cox & Smith Incorporated

[57] ABSTRACT

A firing mechanism for a firearm having a spring pressed firing pin comprises a sear engagable with the spring pressed firing pin in its cocked position and releasable by the sequential release of a sear locking lever and a sear release lever through an abutting contact of a portion of the trigger element with the sear locking lever. The initial and final positions of the trigger, as well as the spring bias imparted to the trigger are readily adjustable, without disassembly. A second stage trigger pull may be incorporated by a second stage lever whose position relative to the trigger may be readily adjusted. All adjustment of the trigger positions, and the spring force on the trigger in either the primary or second stage pull are readily adjustable by screws which are accessible through the between of two horizontally spaced trigger housing plates. Five spacers for the trigger housing plates provide abutments for the various trigger springs and adjustments.

8 Claims, 1 Drawing Sheet

TRIGGER MECHANISM FOR FIREARMS

FIELD OF THE INVENTION

The present invention relates to an improved trigger mechanism for firearms, particularly bolt action rifles and pistols, which will allow for either single-stage or two-stage operation with convenient access to parts and adjustments permitting extreme ranges of pull weights (sub-ounce to several pounds) and trigger travel (short or long) without the necessity of removing the receiver from the stock or the trigger from the receiver.

BACKGROUND OF THE INVENTION

Prior Art

Triggers now in use are designed for either single-stage or two-stage operation only and are limited to narrow ranges of trigger pull weights and travel. Design geometry requires removal of the receiver from the stock or the trigger from the receiver to affect significant changes in either weight or pull or trigger travel.

Some triggers that may be changed from one range of adjustability to another require removal from the receiver and disassembly of the trigger mechanism for access to the parts necessary to effect said changes.

Every user of a firearm, such as a rifle, for highly accurate target or hunting purposes has a preferred trigger pull. Substantially all known trigger mechanisms have a spring bias imparted to the trigger to resist the pulling movement of the operator. The adjustment of the compression or tension forces in the spring opposing the movement of the trigger will provide an adjustment in resisting force of the trigger to the pulling action. Some shooters prefer what is known as a two-stage pull. In the first stage, the trigger moves against a pre-selected spring resistance to a position just short of that required to release the sear and effect the firing of the firearm. At the end of the first stage pull, the trigger encounters additional resistance which indicates to the operator that it is ready for firing with minimum additional trigger travel. The extent of such first stage pull and the amount of additional resistance imparted to the trigger upon entering the second stage is a matter of choice of the firearm operator. Thus, a trigger mechanism should be capable of a variety of adjustments without removal of the entire mechanism from the stock of the firearm, or the trigger mechansim from the receiver.

What is needed is an economically manufacturable trigger mechanism which can be secured to the receiver of firearms and permit the custom adjustment of the pulling characteristics of the trigger mechanism without removal of the trigger mechanism from the receiver or the receiver from the stock.

It is accordingly an object of this invention to provide such improved trigger mechanism.

SUMMARY OF THE INVENTION

A trigger mechanism embodying this invention is housed or mounted within two parallel plates which in turn are readily insertable into the opening customarily provided in the stock and receiver of the firearm for receipt of the trigger mechanism. The trigger housing plates are secured in spaced parallel relationship by a plurality of horizontal spacers. The top ends of the plates are conventionally secured to the bottom of the receiver of the firearm. The trigger housing plates are thus disposed immediately below the path of movement of the breech bolt containing the firing pin which, when cocked, is spring loaded to move forwardly to engage the end of a cartridge inserted in the breech of the gun. A sear is pivotally mounted in the upper portions of the two laterally spaced plates and has a locking projection moveable into the path of movement of the spring pressed firing pin so that a tab on the firing pin engages a locking surface on the sear to retain the firing pin in its cocked position. The sear is spring biased into engagement with the firing pin tab.

In such engaged position, the spring pressed firing pin exerts a force on the sear tending to rotate it in a clockwise direction out of the path of the firing pin. Such clockwise movement of the sear is prevented by a sear release lever which is medially pivotally mounted between the two plate elements and is biased by the same spring operating on the sear into engagement with the sear to prevent clockwise sear rotation of the sear to release the firing pin. Clockwise movement of the sear release lever will release the sear to move out of engagement with the firing pin.

The sear release lever, in turn, is held in its sear locking position by a locking lever. The locking lever is also pivotally mounted between the two trigger housing plates in depending relation to a pin mounted between the top portions of the trigger housing plates. The locking lever has a concave surface formed thereon engagable with a projection on the extreme forward end of the sear locking lever to prevent downward movement of such end of the sear locking lever which would permit the release of the sear from the firing pin.

The trigger has its medial portion pivotally mounted on a transverse pin located adjacent the bottom edges of the two plates. The upper trigger portion has only an abutting contact with the bottom end of the sear release lever. Such abutting contact is provided by a rod shaped projection on the sear release lever which projects horizontally toward the upper portion of the trigger element. A tension spring connects the rod shaped projection and the trigger element and maintains the abutting contact between the projection and the trigger element.

Thus, the application of a pulling force to the depending finger portion of the trigger will produce a counter-clockwise movement of the locking lever, which in turn will release the sear release lever for clockwise movement to permit the sear to be cammed out of engagement with the spring pressed firing pin and effect the firing of the gun.

With the mechanism thus far described, the primary or first stage pull resistance of the trigger is opposed by a separate trigger spring which operates between a rearward projection on the trigger element and a transverse spacer mounted between the trigger housing plates. The spring is disposed in a vertical hole in the rearward trigger projection and the top end of the spring abuts the spacer. An adjustable screw is inserted in the bottom of such hole to provide a convenient means for adjusting the amount of spring force exerted on the trigger as it is pulled. Preferably, a second plate spacer is provided above the rearward projection of the trigger and a stop screw is threaded through the rearward trigger projection to provide an adjustable position stop for the trigger at a position just beyond its firing position.

To adjustably determine the initial position of the trigger, a screw is threaded through a vertical hole in forward trigger projection and engages a third transverse spacer mounted between the trigger housing plates.

To provide a second stage pull, the medial portion of the trigger element is further provided with a forward projection having a downwardly facing shoulder which is engagable by initial trigger pull with the rear end of a medially pivoted second stage control lever. Such control lever is mounted between the bottom portions of the trigger plates by a pin mounted between said plates, and is spring biased in a direction opposing movement of the trigger when the aforementioned downwardly facing shoulder engages the rear end of the second stage control lever. The spring operates between a fourth transverse spacer mounted between the plates and a screw threadably mounted in a vertical hole in the forward end of the second stage control lever. The compressive force in such spring is thus readily adjustable from the bottom of the trigger mechanism.

An adjustable stop is provided to determine the initial position of engagement of the forward projection on the trigger and thus indicate the end of the first stage pull. This adjustment preferably comprises a fifth transverse spacer mounted between the trigger housing plates which is engaged by a threaded screw adjustably mounted in a vertical hole in the rearward portions of the second stage control lever.

When the trigger has been pulled sufficiently to bring the forward projection on the trigger element into engagement with the rear end of the second stage control lever, the shooter feels a definite increase in resistance to trigger pull and is thus advised that firing of the gun is imminent, requiring only a slight additional pull on the trigger.

A unique feature of the aforedescribed construction is the fact that five spacer elements serve not only to mount the trigger housing plates in spaced parallel relationship but also provide an additional function in providing stops for either springs or adjusting screws forming the trigger mechanism.

If a safety mechanism is required, this may be conveniently added to the aforedescribed trigger mechanism. All that is required is a slide or cam that will prevent clockwise movement of the sear release lever when the safety mechanism is in the "safe" position. Manual movement of the safety mechanism to its "firing" position, will permit clockwise movement of the sear release lever by pulling of the trigger.

From the foregoing description, it will be readily apparent to those skilled in the art that a trigger mechanism embodying this invention provides a multiplicity of desirable adjustments which can be made without removing the trigger mechanism from the receiver or the receiver from the stock. All such adjustments are accomplished by screws which are accessible through the spaced bottom portions of the trigger housing plates.

Further advantages of the invention will be readily apparent to those skilled in the art by the following detailed description, taken in conjunction with the annexed sheets of drawings on which is shown a preferred embodiment of the invention.

DETAILED DESCRIPTION OF PREFERRED EMBODIMENT

The trigger mechanism of this invention, while not limited thereto, is designed for use in a bolt action rifle. Such rifle conventionally has a receiver secured to a barrel and the receiver mounts a manually reciprocated bolt which contains a spring pressed firing pin. The receiver and barrel are conventionally supported in a stock. All of these elements are well known in the art and a detailed description or illustration is deemed unnecessary.

Figure 1:
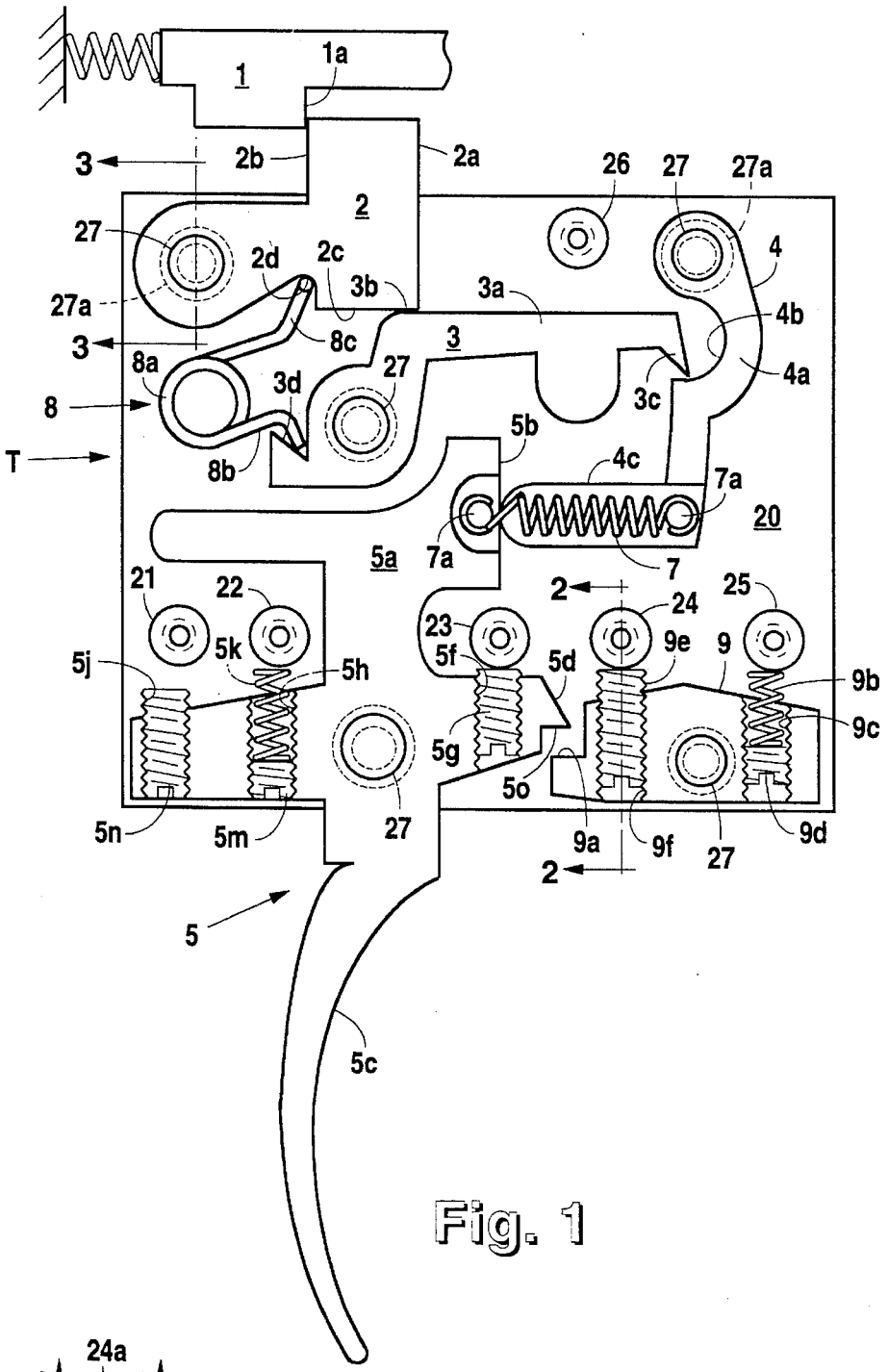
FIG. 1 is a vertical elevational view of the trigger mechanism embodying this invention with one of the side plates of the trigger mechanism removed for clarity of illustration.
Figure 2:
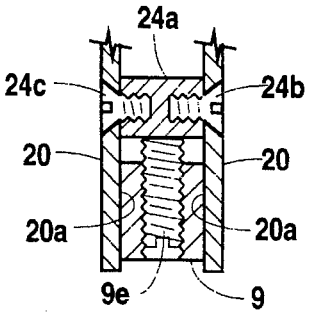
FIG. 2 is a partial sectional view taken on the plane 2—2 of FIG. 1.

Referring to the drawings, the spring pressed firing pin which is normally mounted in the manually actuated bolt (not shown), is schematically illustrated by the numeral 1. Beneath the spring pressed firing pin, a trigger mechanism T is mounted in conventional fashion to the receiver (not shown) of the gun in which the bolt and firing pin are mounted. Trigger mechanism T comprises a pair of plates 20 which are disposed and spaced in parallel relationship by a plurality of spacers 21, 22, 23, 24, 25 and 26. For reasons that will be later described, the spacers 21-25 are preferably mounted in horizontal alignment and adjacent the lower portions of the trigger plates 20, while spacer 26 is mounted near the top central portions of trigger plates. As best shown in FIG. 2, each spacer comprises a cylindrical element, such as **24*a*, which is held in abutting relationship with the inside surfaces 20*a* of the trigger plates 20 by a pair of screws 24*b* and 24*c***. All of the other spacers are of the same construction.

Figure 3:
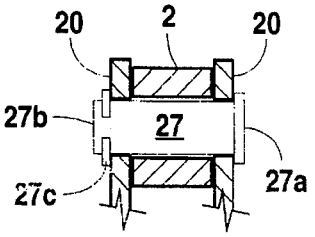
FIG. 3 is a partial sectional view taken on the plane 3—3 of FIG. 1 of a pivot pin assembled between the trigger housing plates.

A sear 2 is provided which is mounted on a horizontal pivot pin 27. Pivot pin 27 is secured between the trigger plates 20 in any conventional fashion. Preferably, such securement is detachable and, as shown in FIG. 3, may comprise a pin having an enlarged head portion **27*a* abutting one side of one trigger plate and a stem portion 27*b* projecting through the other side of the other trigger plate and secured in position by a snap ring 27*c***.

The sear 2 has an upwardly projecting portion **2*a* having a vertical rearward facing planar surface 2*b*, disposed in the path of movement of a depending tab 1*a* on the spring pressed firing pin 1. The firing pin is thus secured in a cocked position by the vertical planar surface 2*b* and imposes a clockwise force on the sear 2** tending to urge it out of engagement with the firing pin.

To prevent such clockwise movement of the sear 2, a sear release lever 3 is provided which is pivotally mounted between the plates 20 on another pivot pin 27. The sear locking lever 3 has a forward, horizontal projection **3*a* having a top horizontal surface 3*b* which engages a horizontal surface 2*c* provided on the bottom of the sear 2. Thus, so long as the sear release lever 3 is locked against clockwise movement about its pivot pin, the sear 2 cannot be released from the spring pressed firing pin 1**.

The sear release lever 3 is held in its cocked position by a sear locking lever 4. Sear locking lever 4 is pivotally mounted in depending relationship on a pivot pin 27, which in turn is mounted between the trigger plates 20. The sear locking lever 4 has a medial depending portion **4*a* that defines a concave locking surface 4*b*. The forward end of the sear release lever terminates in a downward projection 3*c* which frictionally engages the concave surface 4*b* of the sear locking lever 4. Counterclockwise movement of the sear locking lever 4 will release the projection 3*c* of the sear release lever 3, permitting such lever to be moved in a clockwise direction by the clockwise forces imparted to it by the sear 2, hence permitting the sear 2 to move in a clockwise direction and release the firing pin 1. The bottom end of the sear locking lever 4 is provided with a horizontal integral projecting portion 4*c* which, in turn, is abuttingly engaged by the upper portion 5*a* of a trigger element 5**.

Trigger element 5 is pivotally mounted between the trigger housing plates 20 on another pivot pin 27. Such upper trigger element 5a has a vertical face 5b which abuttingly engages the rearward projecting portion 4c of the sear locking lever 4. A tension spring 7 is connected between conventional pins 7a which are respectively mounted on the upper trigger element 5a and the lower end 4d of the sear locking lever 4, to maintain the abutting relationship with sear locking lever 4.

Trigger 5 has a depending finger engagable element 5c which projects downwardly out of the trigger housing plates 20. A pulling movement on the finger element 5c will produce a forward shifting of the upper trigger element 5a, thus causing the projecting portion 4d of the sear locking lever 4 to be shifted horizontally forwardly or in a counterclockwise direction relative to the pivot 27 of the sear locking lever 4. Thus, the sear release lever may be released from the sear, and the sear released from the firing pin to fire the firearm.

To return the trigger mechanism to its cocked position relative to the firing pin 1, a torsion spring 8 is provided which has an medial coiled portion 8a. The arms 8b and 8c of the torsion spring 8 are respectively engaged with a notch 3d in the rearward end of the sear release lever 3 and a notch 2d in the medial portion of the sear 2, thus, imparting a simultaneous bias of the sear 2 and the sear release lever 3 to return these elements to their cocked positions so as to engage the firing pin tab 1a when the bolt (not shown) is reciprocated to load a fresh cartridge into the breech of the gun. The torsion spring 8 effects the return of the sear locking lever to its engaged position with the projection 3d of the sear release lever 3.

It is, of course, necessary to provide a spring to oppose the pulling movement of the trigger 5 and to return the trigger 5 to its normal inactive position after the finger portion 5b of the trigger is released. Three of the spacers 21, 22 and 23 are employed to provide such spring bias to the trigger and to permit the adjustable positioning of the trigger in both an initial and a final position.

The medial portion of trigger 5 comprises a forwardly projecting portion 5d and a rearwardly projecting portion 5e. The forwardly projecting portion 5d is provided with a vertical threaded hole 5f within which a screw 5g is mounted. The screw 5g is thus accessible through the bottom of the horizontally spaced trigger housing plates 20 and engages the spacer 23 to locate the trigger in its inactive position.

The rearwardly projecting medial portion 5e of the trigger is provided with two threaded holes 5h and 5j. A compression spring 5k is mounted in one of the holes and is compressed between an adjusting screw 5m and the spacer 22. Thus, the amount of spring bias opposing pulling movement of the trigger may be conveniently adjusted through the bottom of the trigger housing plates 20.

An adjusting screw 5n is mounted in the second hole 5j and, when the trigger is pulled, determines the maximum limit of the trigger pull by engaging the spacer 21. Obviously, this adjustment should permit the trigger to be pulled beyond its firing position.

From the foregoing description, it is readily apparent that the trigger can function as a single stage firing element, the trigger pull being opposed by the compression of the spring 5k. To provide a two-stage pull, wherein the resistance to pulling force on the trigger is increased just before the trigger reaches the firing position, the forward medial extension 5d provided on the trigger 5 defines a notch having a downwardly facing surface 5o. This surface 5o is in turn engagable with an upwardly facing surface 9a formed on the rear end of a second stage lever 9 medially pivoted on a pivot pin 27. Lever 9 has a clockwise bias imparted to it by a spring 9b mounted in a forward threaded hole 9c and adjustably engaged by a screw 9d. The top end of the spring 9b abuts the spacer 25.

The initial position of the second stage lever 9 is determined by a screw 9e which is adjustably mounted in the threaded hole 9f and abuts the spacer element 24. As in the case of the other adjusting screws provided on the trigger, these screws are readily accessible through the bottom of the laterally spaced trigger housing plates 20.

The second stage lever 9 can therefore be adjustably positioned so that the upwardly facing surface 9a engages the downwardly facing surface 5o on the medial portion of the trigger 5 just prior to the trigger reaching its firing position. Thus, the resistance to further pulling movement of the trigger 5 is increased by having to overcome the spring bias on the second stage lever 9 and the user of the firearm is advised by the feel of the increased resistance that the trigger is close to its firing position.

Those skilled in the art will recognize that this invention is unique in that it permits a wide range of adjustment of trigger position and trigger pull without disassembly of the gun, in addition to permitting the firing of the firearm by either a single stage or a two stage trigger pull.

Modifications of this invention will be readily apparent to those skilled in the art and it is intended that all such modifications be included within the scope of the appended claims.

I claim:

1. A trigger mechanism for cocking and releasing a spring pressed firing pin of a firearm, comprising, in combination:

a trigger housing comprising two horizontally spaced vertical plate elements mountable below said firing pin;

a sear pivotally mounted between said plate elements and releasably engagable with the firing pin in a first pivotal position to secure the firing pin in its cocked position, and disengagable from the firing pin in a second pivotal position;

a sear release lever pivotally mounted between said plate elements and engagable with said sear in one pivotal position to hold said sear in its said first position, and pivotally movable to a second pivotal position permitting movement of said sear to its said second pivotal position;

a locking lever for said sear release lever pivotally mounted between said plate elements and movable between a first pivotal position engaging said sear release lever to hold said sear release lever in its said first position and a second pivotal position permitting movement of said sear release lever to its said second position;

a trigger element medially pivotally mounted between said plate elements below said sear and movable between an initial unpulled position to a pulled firing position;

said trigger element having a finger piece projecting downwardly out of said trigger housing and an upwardly projecting actuating portion;

means abuttingly interconnecting said trigger actuating portion and said locking lever, whereby pulling movement on said finger piece effects movement of said locking lever to its said second position, permitting movement of said sear release lever and said sear concurrently to their respective second positions to release the spring pressed firing pin to fire the firearm;

first resilient means operatively connected between said upwardly projecting actuating element of said trigger and said locking lever to return said locking lever to its said first position upon release of said finger piece of said trigger element; and a second resilient means operable to return said sear and said locking lever to their respective first positions when the firing pin is retracted to its cocked position;

said trigger element having forwardly and rearwardly projecting medial portions;

a plurality of spacer elements securing said vertical plate elements in said horizontally spaced relation;

a spring operating between one of said spacers and said rearwardly projecting portions of said trigger element to urge said trigger to an initial, unpulled position;

a vertically adjustable trigger positioning screw in said forward projecting portion of said trigger;

a second one of said spacer elements abuttingly engaged by said trigger positioning screw to determine said initial unpulled position of said trigger;

a second vertically adjustable screw in said rearwardly projecting portion of said trigger element; and a third one of said spacer elements abuttable by said second vertically adjustable screw to determine the limiting pulled position of said trigger element.

2. The trigger mechanism of claim 1 further comprising adjustable stop means accessible through the space between said plate elements for limiting movement of said trigger element beyond its said firing position.

3. The trigger mechanism of claim 1 wherein said means abuttingly interconnecting said actuating element and said locking lever comprises a projection secured to one of said actuating element and said locking lever and projecting toward the other of said actuating element and said locking lever; and said first resilient means comprises a tension spring connecting said actuating element and said locking lever.

4. The trigger mechanism of claim 1 wherein said second resilient means comprises a U-shaped torsion spring having a coiled medial portion and two end portions, one end portion engaging said sear and the other end portion engaging said sear release lever to bias both said sear and said sear release lever into their said first positons.

5. A trigger mechanism for cocking and releasing a spring pressed firing pin of a firearm, comprising, in combination:

a trigger housing comprising two horizontally spaced vertical plate elements mountable below said firing pin;

a sear pivotally mounted between the upper portions of said plate elements and releasably engagable with the firing pin in a first pivotal position to secure the firing pin in its cocked position, and disengagable from the firing pin in a second pivotal position;

a scar release lever pivotally mounted between said plate elements and engagable with said sear in one pivotal position to hold said sear in its said first position, and pivotally movable to a second pivotal position permitting movement of said sear to its said second pivotal position;

a locking lever for said scar release lever pivotally mounted between said plate elements and movable between a first pivotal position engaging said sear release lever to hold said sear release lever in its said first position and a second pivotal position permitting movement of said sear release lever to its said second position;

a trigger clement medially pivotally mounted between said plate elements below said sear and movable between an initial unpulled position to a pulled firing position;

said trigger element having a finger piece projecting downwardly out of said trigger housing and an upwardly projecting actuating portion;

means abuttingly interconnecting said trigger actuating portion and said locking lever, whereby pulling movement on said finger piece effects movement of said locking lever to its said second position, permitting movement of said sear release lever and said sear concurrently to their respective second positions to release the spring pressed firing pin to fire the firearm;

first resilient means operatively connected between said upwardly projecting actuating element of said trigger and said locking lever to return said locking lever to its said first position upon release of said finger piece of said trigger element; and a second resilient means operable to return said sear and said locking lever to their respective first positions when the firing pin is retracted to its cocked position;

a first stage trigger spring opposing the pulling movement of said trigger element;

a second stage trigger resistance lever pivotally mounted between said plates adjacent said trigger element; and a second spring urging said second stage trigger resistance element to a position in the path of movement of said trigger element when said finger piece is pulled, whereby a detactable increase in trigger resistance is encountered prior to said finger piece reaching its said firing position.

6. The trigger mechanism of claim 5 further comprising means for adjusting the initial pivotal position of said second stage trigger resistance lever to vary the position of initial contact with said trigger element.

7. The trigger mechanism of claim 6 wherein said adjusting means comprises a vertical screw in said second stage resistance lever accessible through the space between said plate elements to adjust the pivotal position of said second stage trigger resistance lever relative to the path of movement of said trigger element.

8. The rigger mechanism of claim 5, wherein a plurality of spacers secure said vertical plate elements in spaced parallel relationship;

said second stage trigger resistance lever being medially pivotally mounted between two of said spacers;

a first threaded vertical hole in said second stage trigger resistance lever underlying one of said spacers;

a first adjusting screw insertable in the bottom end of said first hole;

a spring disposed between said first adjusting screw and said one spacer;

a second vertical threaded hole in said second stage trigger resistance lever underlying the other one of said two spacers; and a second adjustable screw mounted in said second hole and engagable with said other spacer to adjustably position said second stage trigger resistance lever relative to said trigger element.

* * * * *